US011048213B2

(12) United States Patent
Silvant et al.

(10) Patent No.: US 11,048,213 B2
(45) Date of Patent: Jun. 29, 2021

(54) EXTERNAL ASSEMBLY ELEMENT WITH INTEGRATED COMMUNICATION CIRCUIT

(71) Applicant: Omega S.A., Biel/Bienne (CH)

(72) Inventors: Olivier Silvant, Macolin (CH); Gregory Kissling, Macolin (CH); Yvan Ferri, Lausanne (CH)

(73) Assignee: Omega S.A., Biel/Bienne (CH)

( * ) Notice: Subject to any disclaimer, the term of this patent is extended or adjusted under 35 U.S.C. 154(b) by 127 days.

(21) Appl. No.: 15/759,037

(22) PCT Filed: Aug. 30, 2016

(86) PCT No.: PCT/EP2016/070388
§ 371 (c)(1),
(2) Date: Mar. 9, 2018

(87) PCT Pub. No.: WO2017/042053
PCT Pub. Date: Mar. 16, 2017

(65) Prior Publication Data

US 2019/0271954 A1 Sep. 5, 2019

(30) Foreign Application Priority Data

Sep. 10, 2015 (EP) ..... 15184594

(51) Int. Cl.
*G04R 60/08* (2013.01)
*G04B 19/28* (2006.01)
*G04G 21/04* (2013.01)

(52) U.S. Cl.
CPC ..... *G04R 60/08* (2013.01); *G04B 19/283* (2013.01); *G04G 21/04* (2013.01)

(58) Field of Classification Search
CPC ..... G04B 19/18; G04B 19/283; G04R 60/08; H01Q 1/242; H01Q 1/243; H01Q 1/273; G04G 21/04
See application file for complete search history.

(56) References Cited

U.S. PATENT DOCUMENTS 2,252,647 A 8/1941 Schmitz
5,798,984 A 8/1998 Koch
6,825,751 B1 * 11/2004 Kita ..... G06K 19/07762 340/10.52
9,153,856 B2 * 10/2015 Rappoport ..... H01Q 1/243
(Continued)

FOREIGN PATENT DOCUMENTS

CH 322541 A * 6/1957 ..... G04B 19/18
EP 2228695 A1 9/2010
(Continued)

OTHER PUBLICATIONS

Rolex, English Translation of CH 322541, originally published Jun. 15, 1957, retrieved from Espaceneton Sep. 13, 2019, full document (Year: 1957).*
(Continued)

*Primary Examiner* — Daniel P Wicklund
(74) *Attorney, Agent, or Firm* — Oblon, McClelland, Maier & Neustadt, L.L.P.

(57) ABSTRACT

An external assembly element of a timepiece made from a first material, including a groove in which a communication circuit is arranged, wherein the communication circuit is over-molded with a polymer material filling the groove.

11 Claims, 5 Drawing Sheets

(56) References Cited

U.S. PATENT DOCUMENTS

| | | | | |
|---|---|---|---|---|
| 10,361,479 | B2 * | 7/2019 | Montevirgen | |
| 2006/0140058 | A1 | 6/2006 | Kalbermatten et al. | |
| 2011/0103199 | A1 * | 5/2011 | Winkler | G04B 19/18 368/285 |
| 2011/0259753 | A1 * | 10/2011 | Grossenbacher | B44C 1/26 205/162 |
| 2013/0208577 | A1 * | 8/2013 | Netuschill | B44C 1/26 368/285 |
| 2017/0131738 | A1 * | 5/2017 | Lai | H01Q 7/00 |
| 2019/0250566 | A1 * | 8/2019 | Ferri | G04R 60/08 |

FOREIGN PATENT DOCUMENTS

| | | | |
|---|---|---|---|
| JP | 9-119986 | A | 5/1997 |
| WO | 2005/065404 | A2 | 7/2005 |

OTHER PUBLICATIONS

International Search Report dated Nov. 8, 2016, in PCT/EP2016/070388, filed Aug. 30, 2016.

* cited by examiner

EXTERNAL ASSEMBLY ELEMENT WITH INTEGRATED COMMUNICATION CIRCUIT

The present invention relates to an external assembly element of a timepiece made from a first material.

TECHNOLOGICAL BACKGROUND

The present invention relates to a rotating bezel for a timepiece.

Bezel systems that rotate or not are known. A rotating bezel system comprises an annular bezel having an upper face and a lower face, the upper face being the face visible to the user. This bezel comprises a toothing system that cooperates with a spring element for rotating bezel systems. This cooperation between the spring element and the toothing of the bezel enables provision of a bezel that is rotatable in a stepwise manner.

As the development of communication functions progressed, it was necessary to find spaces for the communication circuits. One solution was to integrate these communication circuits into the bezel. A bezel fitted with a hollow space forming a slot, in which the communication circuit and the antenna are placed, is known for this. The whole assembly is then sealed with a cover.

The slot can be filled with a resin to restrict movement of the communication circuit and the antenna therein.

However, this construction has the disadvantage of being complex, since it requires a cover for close the slot and also communication devices in two component parts: circuit on the one hand and antenna on the other. Moreover, this is a construction that is easy to disassemble for an ill-intentioned person who might wish to retrieve the communication circuit and the data stored on it.

SUMMARY OF THE INVENTION

The aim of the invention is to remedy the disadvantages of the prior art by proposing to provide a bezel system fitted with a communication circuit that is simple, sealed and secure.

For this purpose, the invention relates to an external assembly element of a timepiece made from a first material, characterised in that it comprises a groove, in which a communication circuit is arranged, wherein said communication circuit is over-moulded with a polymer material filling said groove.

In a first advantageous embodiment the external assembly element additionally comprises a dial train element enabling indication of the minutes, wherein this dial train element comprises a strip made from a second material, this strip having areas of excess thickness forming index numbers.

In a second advantageous embodiment the second material forming the strip is a transparent material, wherein the dial train element additionally comprises a second strip made from a luminescent material.

In a third advantageous embodiment the dial train element is positioned between the communication circuit and the over-moulding of polymer material and is arranged so that the areas of excess thickness are flush with the surface of the over-moulding.

In a fourth advantageous embodiment the communication circuit is covered by a first over-moulding, on which the dial train element is positioned, a second over-moulding being arranged on the dial train element, and the first and second over-mouldings are arranged so that the areas of excess thickness are flush with the surface of the second over-moulding.

In a fifth advantageous embodiment the dial train element is made from a material chosen from the following list: metal, ceramic, wood, rock.

In a sixth advantageous embodiment the dial train element is made from a material comprising a polymer, into which a luminescent pigment is mixed.

In a seventh advantageous embodiment the polymer material forming the over-moulding is over-moulded in order to form hollow spaces and said hollow spaces are filled with a luminescent material.

The invention additionally relates to a timepiece comprising a case comprising a middle part closed by a back and a glass and fitted with a bezel, characterised in that the bezel is the external assembly element according to one of the preceding claims.

In a first advantageous embodiment the bezel and the middle part only form one and the same single piece.

BRIEF DESCRIPTION OF THE FIGURES

The aims, advantages and features of the bezel system according to the present invention will become clearer in the following detailed description of at least one embodiment of the invention given solely as a non-restrictive example and illustrated by the attached drawings.

DETAILED DESCRIPTION

The present invention proceeds from the general inventive idea consisting of providing a rotating bezel system that is simpler to assemble.

Figure 1:
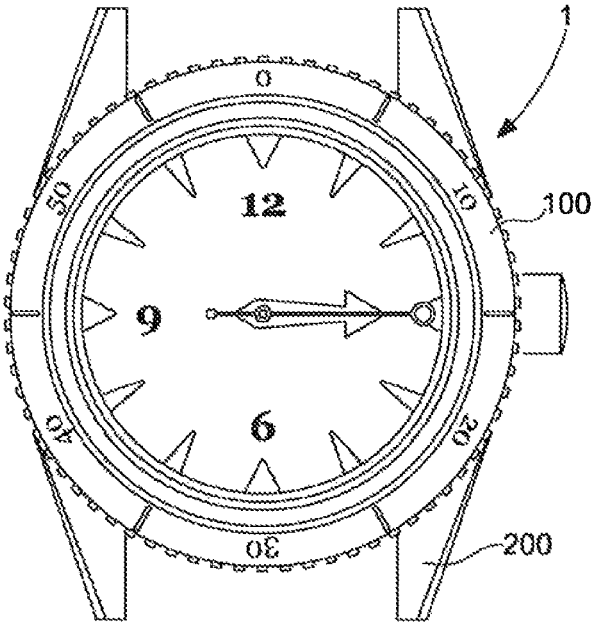
FIG. 1 shows a general view of the present invention.
Figure 2:
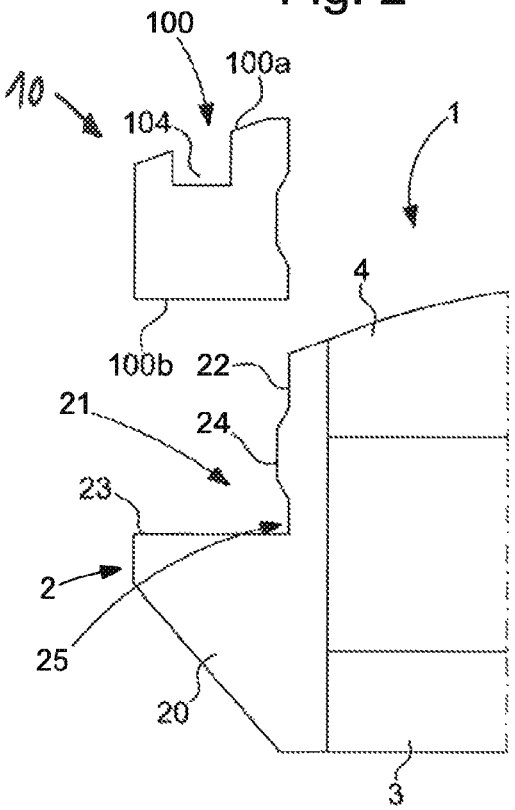
FIGS. 2 and 3 show detailed views of the bezel serving as external assembly element according to the present invention.

FIGS. 1 and 2 show an external assembly element 10 such as a bezel 100 according to the invention, this bezel 100 being mounted on a timepiece 1 comprising a case 2 closed by a back 3 and a glass 4. This bezel 100 is a piece with an annular shape, which comprises an upper face 100*a* visible to the user and a lower face 100*b*. This bezel 100 could be made from a plastic or ceramic material or any other electrically non-conductive material.

This bezel 100 can be mounted to be rotating or not at the level of the middle part. In the case of a rotating bezel 100, a spring-catch assembly or a ratchet locking system (not shown) is provided. This spring-catch assembly comprises spring means and a toothed element. One of the elements of the spring-catch assembly will be angularly fixed to the middle part, whereas the other will be angularly fixed to the bezel 100 in order to allow the bezel to be indexed angularly in relation to the middle part.

For assembly of the bezel 100 the timepiece comprises a middle part 20, in which a shoulder 21 is arranged, this shoulder 21 being defined by a side wall 22 and a base 23. This shoulder serves as a seating for the bezel. In general, the side wall 22 comprises a protuberance 24 extending over the entire perimeter of the side wall 22. This protuberance 24 in cooperation with the base 23 and the wall 22 allows definition of a holding groove 25. This holding groove 25 enables the bezel to be inserted and held therein during its eventual assembly.

Figure 3:
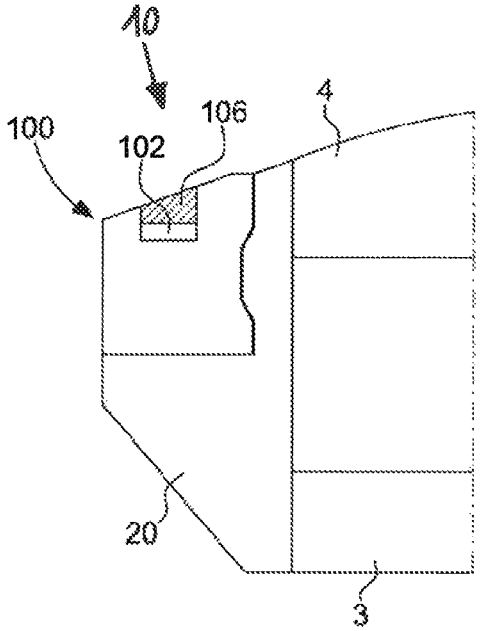

Advantageously, according to the invention the bezel 100 is fitted with a communication circuit 102, as visible in FIGS. 2 and 3. For this, the bezel is configured so that it is provided with a groove 104 at the level of the upper face 100*a*, and this groove 104 is also annular, i.e. extends along the upper face 100*a*. A communication circuit 102 comprises a support, i.e. a printed circuit that has a shape similar to that of the groove 104 arranged on the bezel, i.e. is ring-shaped. In the present case the printed circuit serves as substrate for a spiral antenna and the different electronic components that enable the system to function are arranged there.

The entire assembly is then placed in the groove 104 of the bezel 100 that serves as seating.

To close the entire assembly, a rubber-type polymer material is over-moulded directly into the groove 104 forming an over-moulding 106, as visible in FIG. 3. This classic over-moulding operation is intended to completely cover the communication circuit 102 in the shape of a ring. This complete coverage, on the one hand, enables the system to be well sealed, since the polymer material is inserted into the entire groove 104, thus preventing any liquids from entering.

A second advantage of this arrangement is that it allows the security of this bezel to be improved. In fact, the communication circuits 102 for this bezel 100 can use non-contact NFC type communication protocols or other wireless telecommunication means. This system can also be used as an electronic tag for product recognition (or tracking). This protocol is principally used for payment functions which means that these circuits contain sensitive data. Consequently, it is necessary to protect them. Since the non-contact communication protocols have extremely close ranges, the recovery of sensitive data occurs directly on the circuit. Consequently, the fact that a polymer is over-moulded onto the communication circuit 102 makes the recovery of information more difficult, because the polymer will have to be dissolved before gaining access to the communication circuits 102.

Moreover, the presence of an over-moulding operation means an adaptive bezel can be provided, i.e. it is conceivable to not have just a communication circuit. In fact, it is conceivable to add dial train indications and/or other technical or decorative indications at the level of the bezel.

Figure 4:
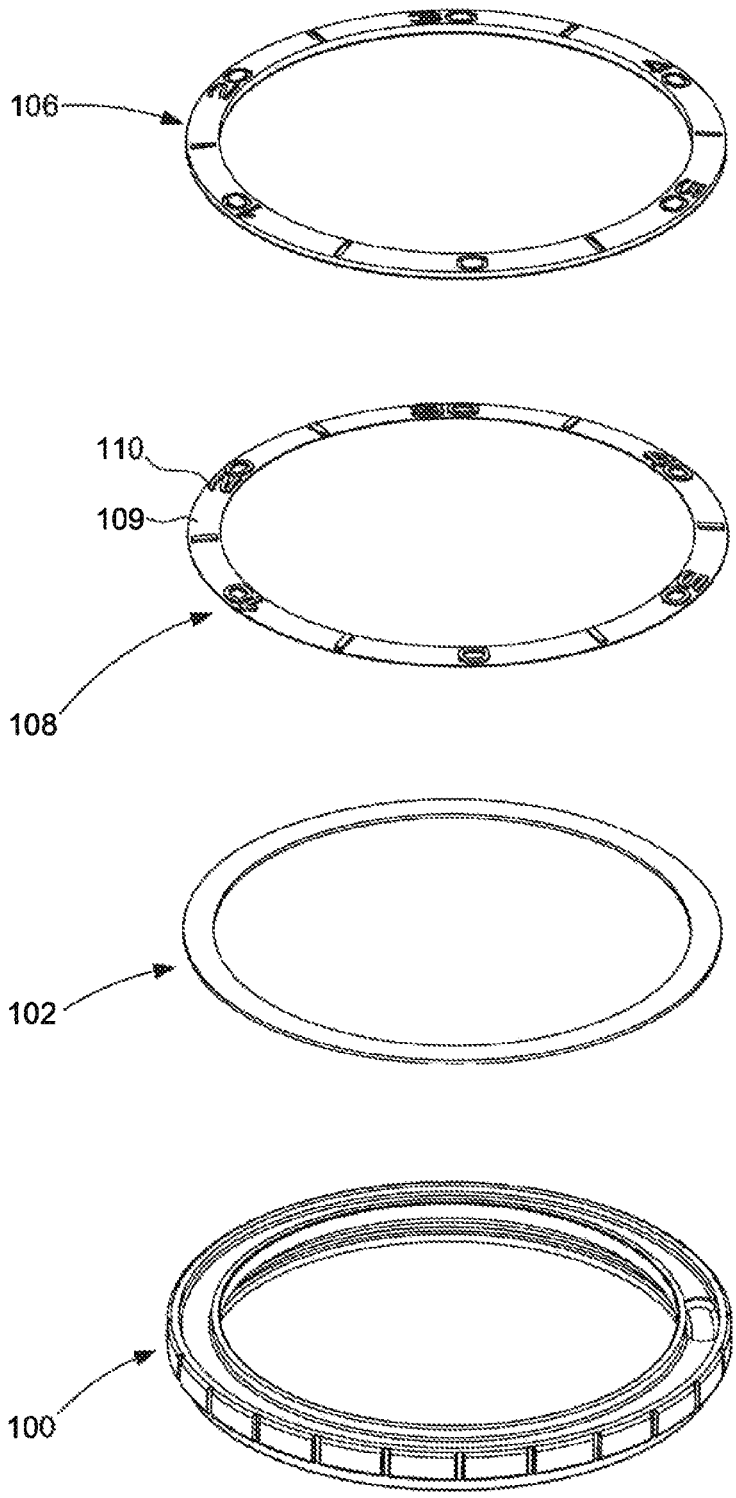
FIGS. 4 and 5 show a first alternative of a first embodiment of the invention according to the present invention.

According to an advantageous embodiment the bezel 100 according to the invention additionally comprises a dial train element 108. This dial train element 108 is provided in the form of a strip or lamella 109, the dimensions of which allow it to be positioned in the groove 104 of the bezel 100, as visible in FIG. 4. In the case of the bezel 100 the strip 109 is annular in shape. This strip 109 is provided in the form of a ring made from a plastic or metallic material or organic material such as wood or from a crystalline material such as sapphire or ruby or ceramic or from a polymer material incorporating a luminescent—phosphorescent or fluorescent—element. Dial train index numbers 110 are then configured in relief, i.e. in areas of excess thickness. This ring 109 is then deftly placed in the groove.

Two alternatives are possible for this installation of the dial train ring 108.

Figure 5:
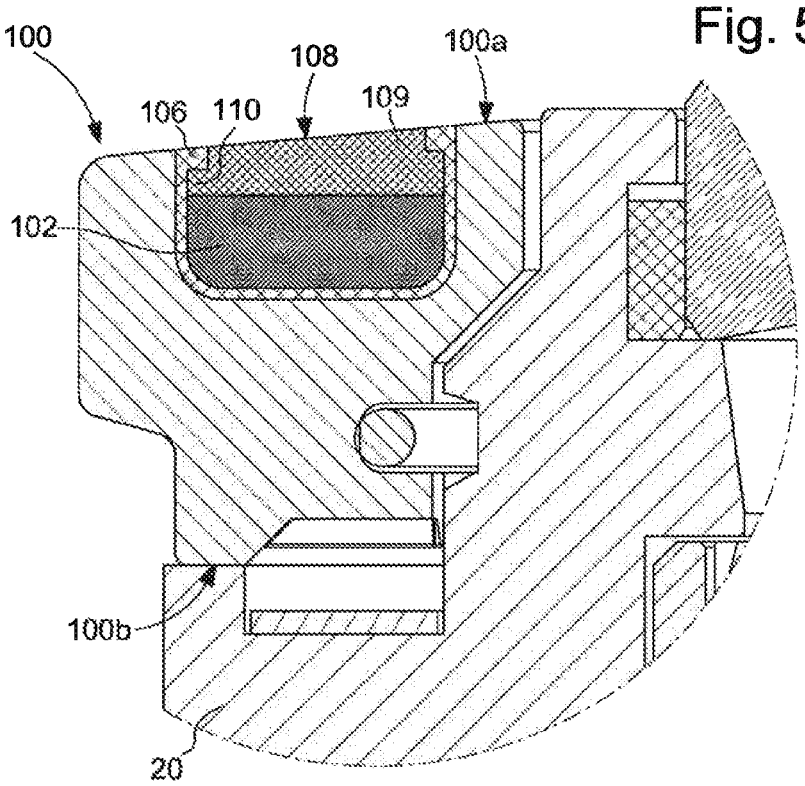

The first alternative consists of dimensioning the groove 104 so that, when the dial train element 108 is positioned in the groove 104, the reliefs 110 are flush with the plane of the upper surface 100*a* of the bezel 100. The whole assembly is then over-moulded by the polymer forming the over-moulding 106. The flush arrangement of the index numbers 110 during the over-moulding results in reliefs that are visible to the user, as visible in FIG. 5.

Figure 6:
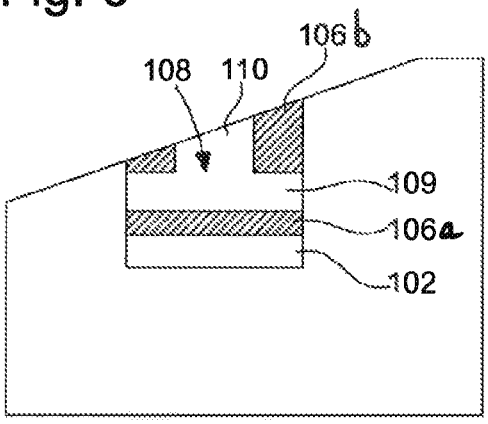
FIG. 6 shows a second alternative of a first embodiment of the invention according to the present invention.

A second alternative consists of over-moulding a first polymer layer or over-moulding 106*a* on the communication circuit 102 before installing the dial train element 108. A second over-moulding operation is then conducted to deposit a second polymer layer or over-moulding 106*b* to hold the dial train element 108 in the groove 104 of the bezel 100. The thickness of the first deposited polymer layer 106*a* will be defined so that the reliefs of the dial train element 108 are flush with the plane of the upper surface 100*a* of the bezel 100, as visible in FIG. 6.

Figure 7:
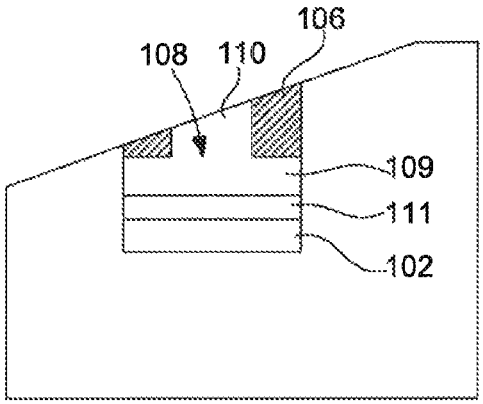
FIG. 7 shows as variant of the first embodiment of the invention according to the present invention.

In a variant of the two alternatives, the dial train element 108 is designed to comprise a first dial train strip 109 made from a transparent material and a second leaf 111 arranged below the dial train strip 109 that will be a luminescent leaf. Thus, it is possible to have a luminescent appearance in the case where a mixture of the material of the dial train strip 109 and the luminescent pigment is not possible, as visible in FIG. 7.

Figure 8:
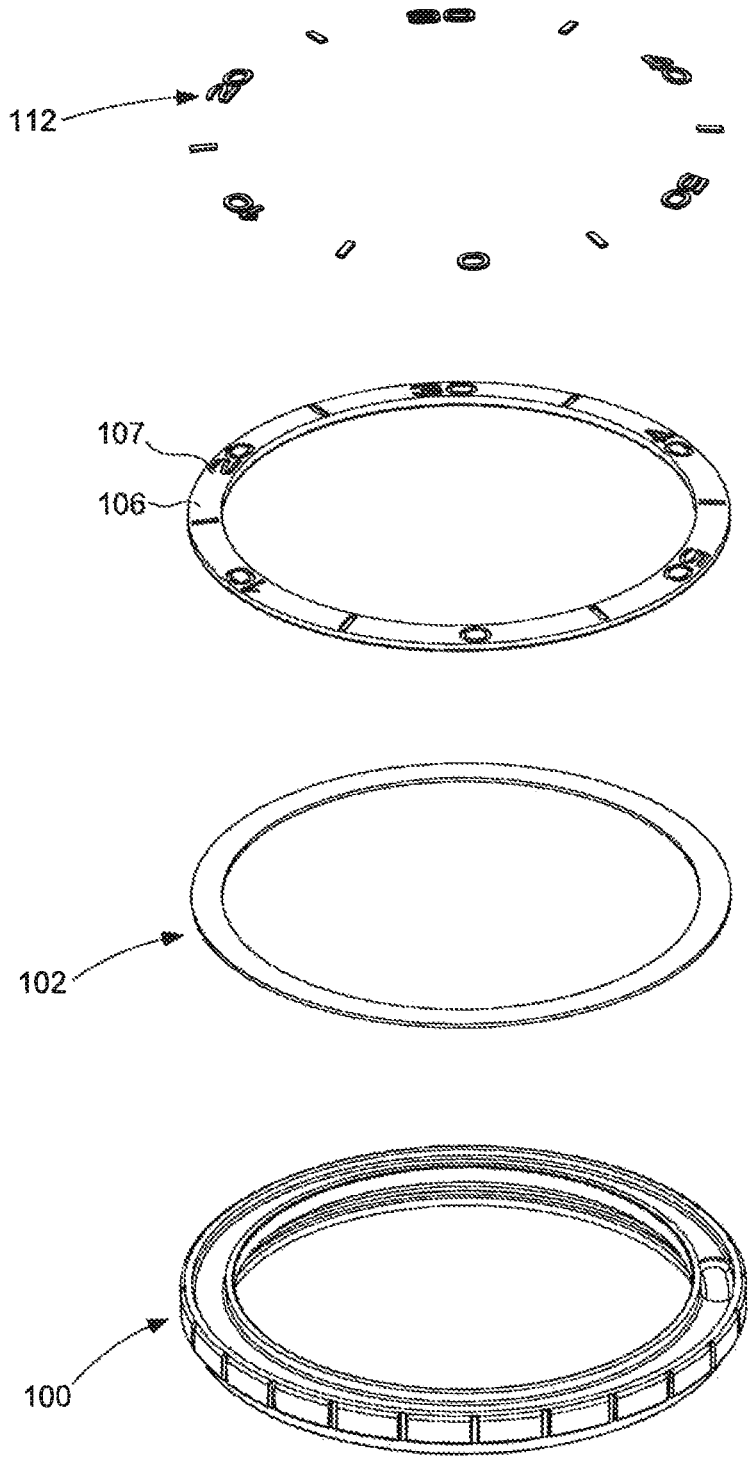
FIGS. 8 and 9 show a second embodiment according to the present invention.
Figure 9:
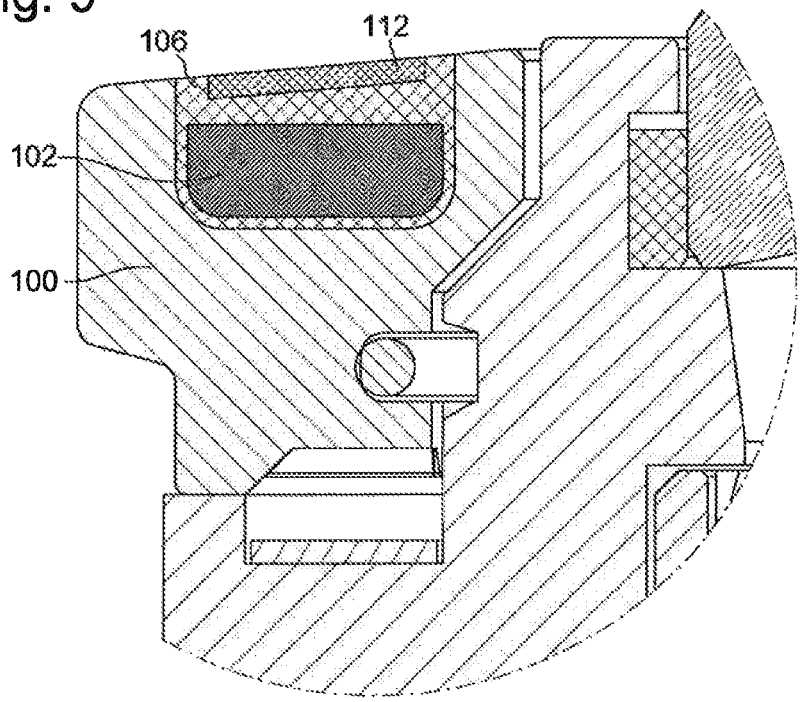

According to another advantageous embodiment visible in FIGS. 8 and 9 a dial train marking is present on the bezel 100. For this, the over-moulding of the groove with a polymer is conducted in order to form hollows 107 on its surface. These hollows 107 preferably have the shapes of dial train index numbers. The purpose of these hollows 107 is to be filled by a layer 112 of a material such as an ink. This can also be deposited by spraying or silk screen printing. This ink could be luminescent or not, depending on requirements. The hollow spaces can also be filled with a metal such as an amorphous metal.

Figure 10:
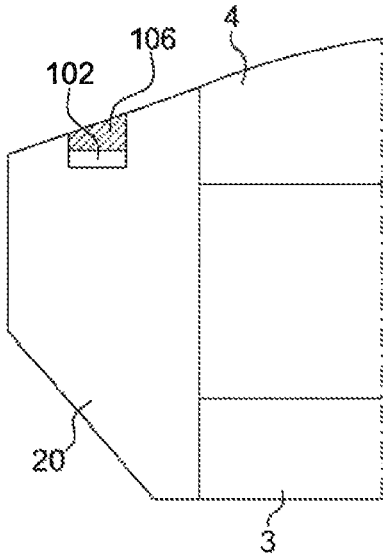
FIG. 10 shows the invention when the middle part of the bezel only forms a single piece.

In another embodiment visible in FIG. 10 it is conceivable that the bezel is integrated. For this purpose, the middle part is configured so that at least one of its faces can serve as bezel, and this middle part is then referred to as a bezel middle part. In this embodiment the face of the middle part serving as bezel is provided with the hollow space, in which the communication circuit is positioned.

It will be understood that various modifications and/or improvements and/or combinations evident to the person skilled in the art can be made to the different embodiments of the invention outlined above without departing from the framework of the invention defined by the attached claims.

The invention claimed is:

1. An external assembly element of a timepiece made from a first material, comprising:

a communication circuit;

a groove in which the communication circuit is arranged; and a dial train element including areas of excess thickness forming index numbers, wherein the communication circuit is covered by a first over-molding, the first over-molding including a polymer material filling the groove, wherein the areas of excess thickness are flush with an upper surface of the first over-molding and flush with an upper surface of the external assembly element, and wherein the first over-molding is in contact with each of the dial train element and the communication circuit in the groove.

2. The external assembly element according to claim 1, wherein the dial train element enables indication of minutes, and wherein the dial train element includes a first strip made from a second material, the first strip including the areas of excess thickness forming index numbers.

3. The external assembly element according to claim 2, wherein the second material forming the first strip is a transparent material, wherein the dial train element further comprises a second strip made from a luminescent material.

4. The external assembly element according to claim 2, wherein the dial train element is positioned between the communication circuit and the first over-molding of polymer material.

5. The external assembly element according to claim 2, further comprising:

a second over-molding, wherein the communication circuit is covered by the first over-molding, on which the dial train element is positioned, wherein the second over-molding is arranged on the dial train element, and wherein the first and second over-moldings are arranged so that the areas of excess thickness are flush with a surface of the second over-molding.

6. The external assembly element according to claim 2, wherein the dial train element is made from a material chosen from: metal, ceramic, wood, or rock.

7. The external assembly element according to claim 2, wherein the dial train element is made from the second material that comprises a polymer, into which a luminescent pigment is mixed.

8. The external assembly element according to claim 1, wherein the polymer material forming the first over-molding is over-molded to form hollow spaces filled with a luminescent material.

9. The external assembly element according to claim 1, made from an electrically non-conductive material.

10. A timepiece comprising:

a case comprising a middle part closed by a back and a glass and fitted with a bezel, wherein the bezel is the external assembly element according to claim 1, and wherein the groove is annular.

11. The timepiece according to claim 10, wherein the bezel and the middle part only form one and same single piece.

* * * * *